US006681420B1

(12) United States Patent
Ball

(10) Patent No.: US 6,681,420 B1
(45) Date of Patent: Jan. 27, 2004

(54) METHOD AND APPARATUS FOR INSTALLING A BATHTUB ASSEMBLY

(75) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

(21) Appl. No.: 10/308,946

(22) Filed: Dec. 3, 2002

(51) Int. Cl.[7] ..... E03C 1/12

(52) U.S. Cl. ..... 4/680

(58) Field of Search ..... 4/679, 680, 682, 4/683, 684, 686, 688, 693, 694; 137/798; 285/31, 32, 144.1, 145.1, 145.4, 417

(56) References Cited

U.S. PATENT DOCUMENTS

| | | | | | |
|---|---|---|---|---|---|
| 843,968 | A | * | 2/1907 | Sharp, Jr. | 4/684 |
| 4,035,002 | A | * | 7/1977 | Curtin | 285/31 |
| 4,690,434 | A | * | 9/1987 | Schmidt | 242/594.3 |
| 4,920,582 | A | * | 5/1990 | Alker | 4/683 |
| 5,257,648 | A | * | 11/1993 | Oropallo | 138/90 |
| 5,313,677 | A | * | 5/1994 | Coe | 4/683 |
| 5,890,241 | A | * | 4/1999 | Ball | 4/538 |
| 6,318,761 | B1 | * | 11/2001 | Robertson | 285/31 |

* cited by examiner

*Primary Examiner*—Gregory Huson
*Assistant Examiner*—Huyen Le

(57) ABSTRACT

An apparatus and method for installing a bathtub assembly where an overflow assembly secured to an overflow port of a bathtub and a drain assembly secured to a drain port of a bathtub are adhesively secured to a T-section by use of an overflow hub and drain hub.

8 Claims, 8 Drawing Sheets

METHOD AND APPARATUS FOR INSTALLING A BATHTUB ASSEMBLY

BACKGROUND OF THE INVENTION

This invention is directed toward a method and apparatus for installing a bathtub assembly and more specifically to an easier and simplified method and apparatus for installing the same.

Bathtub assemblies are well-known in the art. Generally, such an assembly includes an overflow assembly, a drain assembly and a T-section that threadably secures the two together. Threadably securing the T-section into both the overflow assembly and the drain assembly not only can be awkward and time consuming, but can also require more than one person to hold the assemblies in place. Therefore, there is a need for a better device and method for installing a bathtub assembly.

Accordingly, a primary objective of this invention is to provide a bathtub device that can be installed quickly with a minimum of manpower.

A further object is to provide a simple method for installing a bathtub assembly.

These and other objectives will become apparent to those skilled in the art based on the following disclosure.

BRIEF SUMMARY OF THE INVENTION

This invention involves a method and apparatus for installing a bathtub assembly in a conventional bathtub having end walls, side walls, and a bottom with an overflow port in one of the end walls and a drain port in the bottom of the tub. The assembly includes an overflow assembly that extends through and is secured to the overflow port. The overflow assembly has a first end that extends through the overflow port, an elbow portion, and a second end to which is an overflow hub is slidably connected. The assembly further includes a drain assembly with a first end secured to the bottom of the tub, an elbow portion, and a second end with a drain hub slidably connected to the second end. A T-section having a vertical member with a first end, a second end, and a horizontal member is adhesively secured to the overflow assembly and the drain assembly.

DESCRIPTION OF THE PREFERRED EMBODIMENTS

Figure 1:
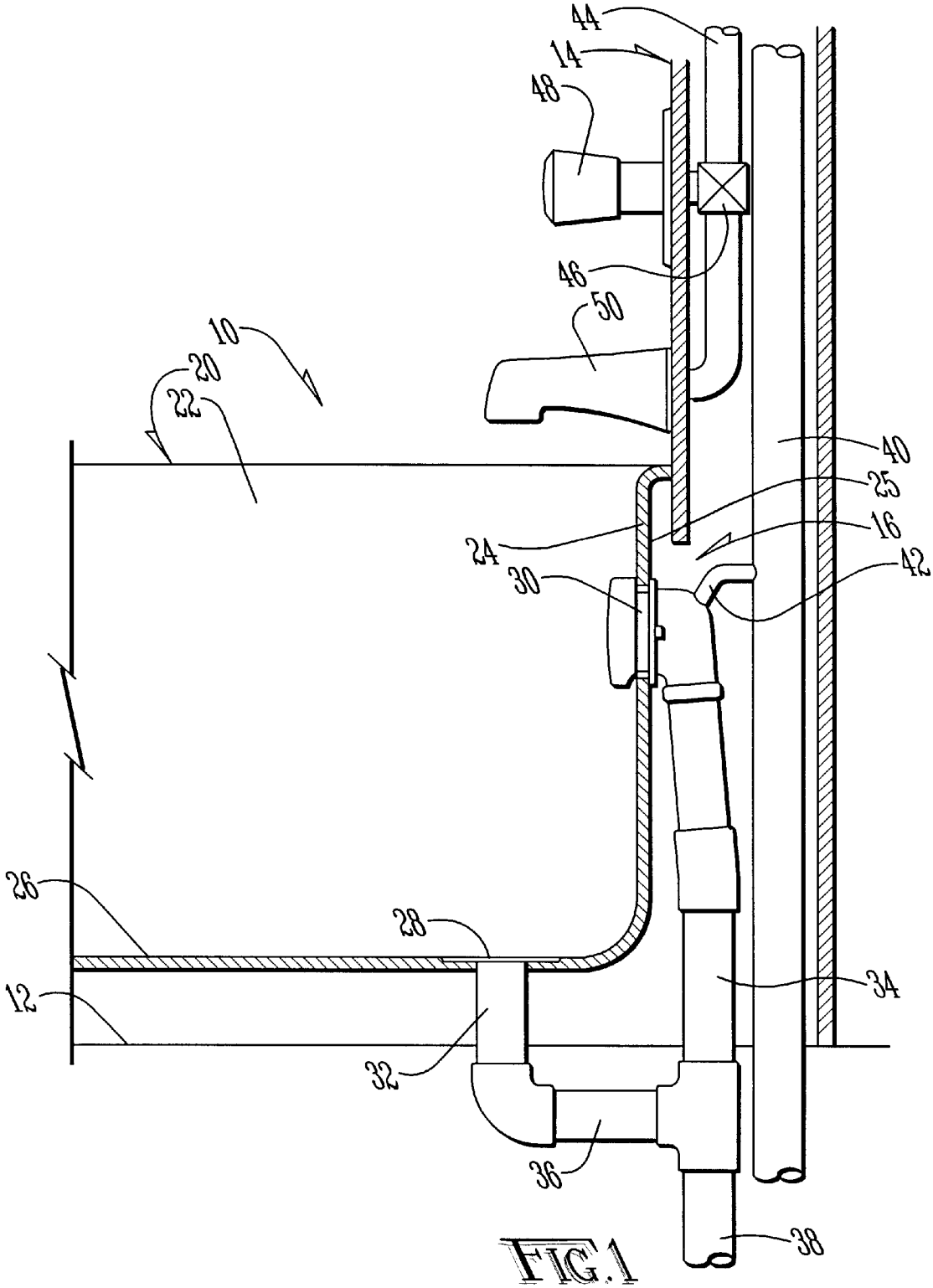
FIG.1 (PRIOR ART)
FIG. 1 is a side sectional view of a prior art bathtub assembly.

With reference to FIG. 1, a conventional bathroom structure 10 has a floor 12, and a hollow wall 14 with a wall opening 16 therein. A conventional bathtub (hereinafter "tub") 20 rests upon floor 12.

The tub 20 has side walls 22, end walls 24, and a bottom 26. The side walls 22 extend upwardly from the bottom 26. The end walls 24 extend upwardly from the bottom 26, perpendicular to the side walls 22, and have an outer surface 25.

A drain port 28 is located in the bottom 26. A conventional overflow port 30 is located in the end wall 24. A first vertical drain pipe 32 extends downwardly from drain port 28. A second vertical drain pipe 34 extends downwardly from the overflow port 30. A horizontal pipe 36 threadably connects pipes 32 and 34. A primary drain pipe 38 extends downwardly from the junction of pipes 34 and 36.

A conventional vertical vent pipe 40 is located within the hollow wall 14. A connector vent pipe 42 is in fluid flow communication with the vent pipe 40 and the upper end of the second vertical drain pipe 34.

Conventional water pipes 44 extend through hollow wall 14 and are connected to a valve 46. The valve 46 is interconnected with conventional control members 48 and faucet 50.

Figure 2:
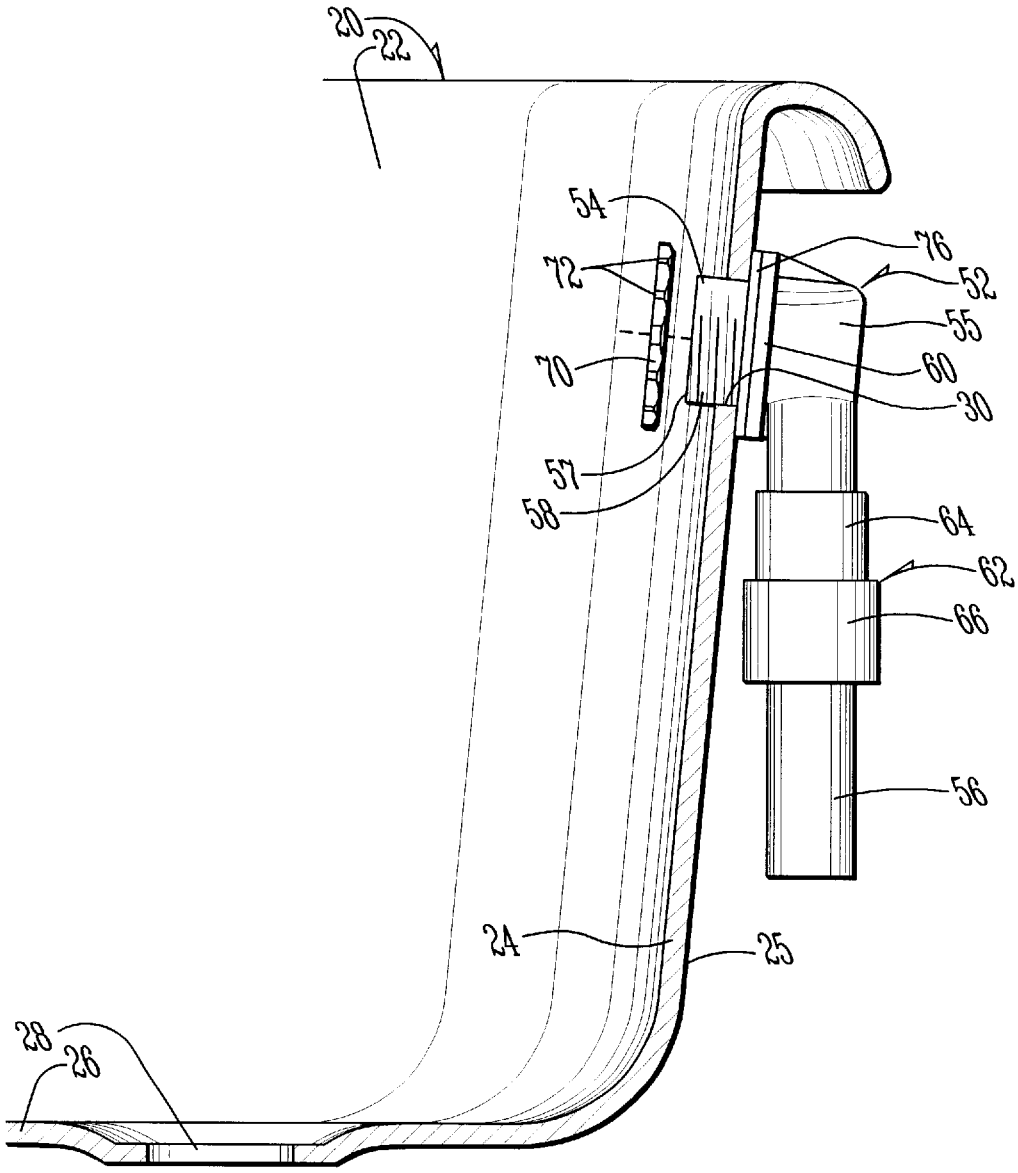
FIG. 2 is a side sectional view of the overflow assembly of this invention in an initial stage of assembly.

With reference to FIG. 2, and overflow assembly 52 is secured to the overflow port 30. The overflow assembly 52 has a first end 54, and elbow portion 55, and a second end 56. The first end 54 has threads 58 on its outer surface and also the outer end 57 that defines an inlet 59 that is adapted to fit through the overflow port 30.

The overflow assembly 52 also has a lip 60 that extends radially outwardly from the outer surface of the first end 54 between the outer end 57 of the first end 54 and the elbow portion 55. The lip 60 is spaced from the inlet 59 to engage the outer surface 25 of the bathtub end wall 24 around the overflow port 30, thereby allowing only the inlet 59 to pass through the overflow port 30.

Slidably connected to the second end 56 of the overflow assembly 52 is an overflow hub 62. The overflow hub has a first section 64 and a second section 66 where the inner diameter of the first section 64 is slightly greater than the diameter of the second end 56 of the overflow assembly 30 and the inner diameter of the second section 66 is greater than the inner diameter of the first section 64.

Sealed to the outer end 57 of the first end 54 is a thin diaphragm or film 68. The diaphragm 68 is a circular membrane and as a diameter that is not less than the diameter of the outer end 57 of the first end 54. In one embodiment the diaphragm 68 is integral with the outer end 57 and is held to the outer end 57 only through having been integrally formed therewith. The diaphragm 68 may be hermetically sealed to the outer end 57. The diaphragm 68 may be composed of plastic material, flexible rubber, or the like. The diaphragm 68 is composed of material that is easily punctured or easily removable.

Figure 8:
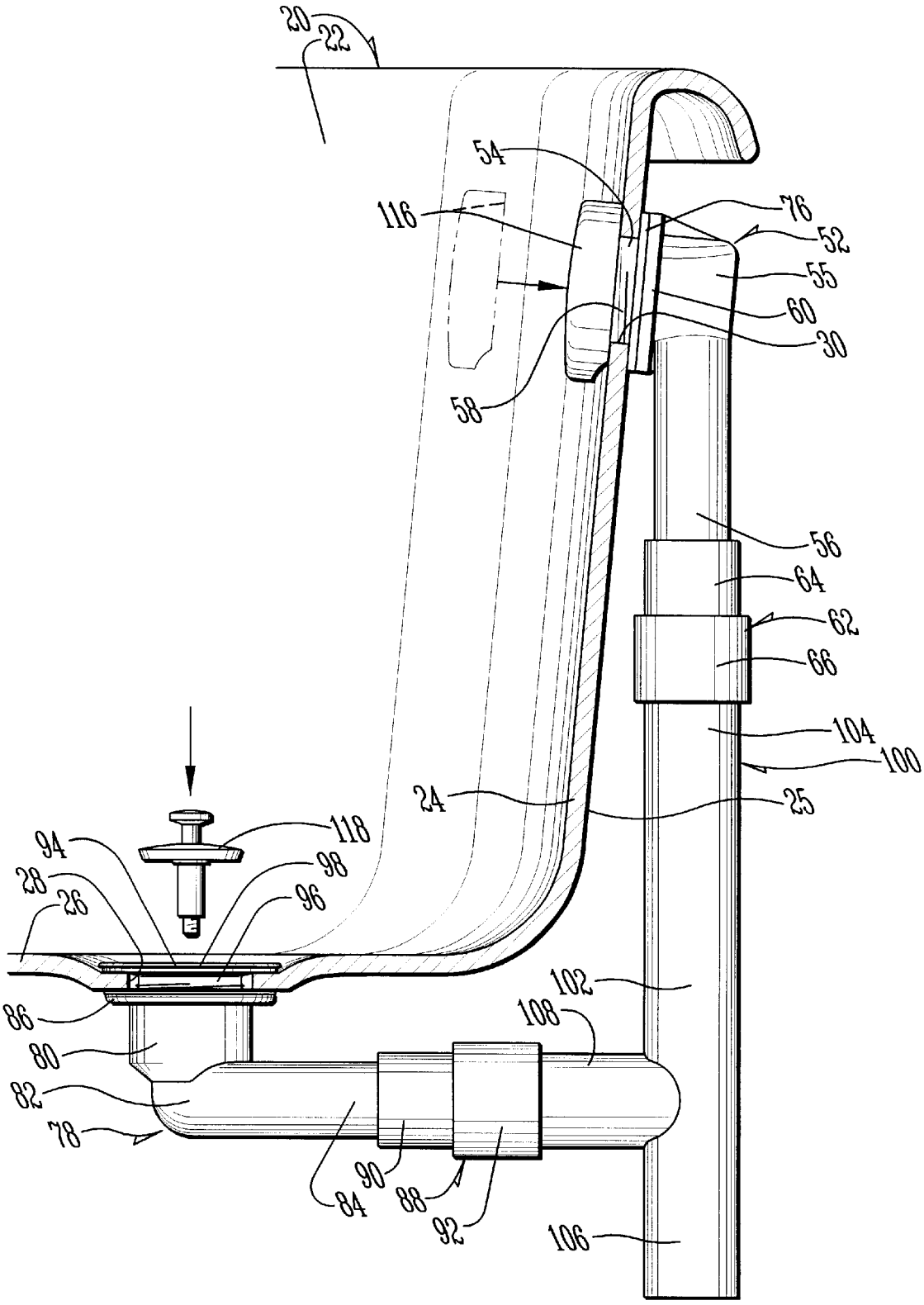
FIG. 8 is a side sectional view of the bath assembly showing the installation of the face plate and the drain closure.

The overflow assembly 52 further includes a nut element 70 having threads compatible with the threads 58 on the inlet 59 of the first end 54. The nut element 70 removably secures the overflow assembly 52 to the bathtub 20 by compressing the end wall 24 between the nut element 70 and the lip 60. The nut element 70 may be a slip nut. As shown in FIG. 2, the nut element 70 has a series of radially extending lugs 72 along the outer periphery of the nut 70. These lugs 72 detachably engage the inner surface of the cap 74 (FIG. 8). The cap serves to cover the overflow assembly hardware.

During installation of the overflow assembly 52, a washer 76 may be placed over the inlet 59 and against the lip 60 as that when the nut element 70 is threadably mounted to the inlet 59, the washer 76 engages the outer surface 25 of the end wall 24 to seal the overflow assembly 52 to the tub 20.

Figure 3:
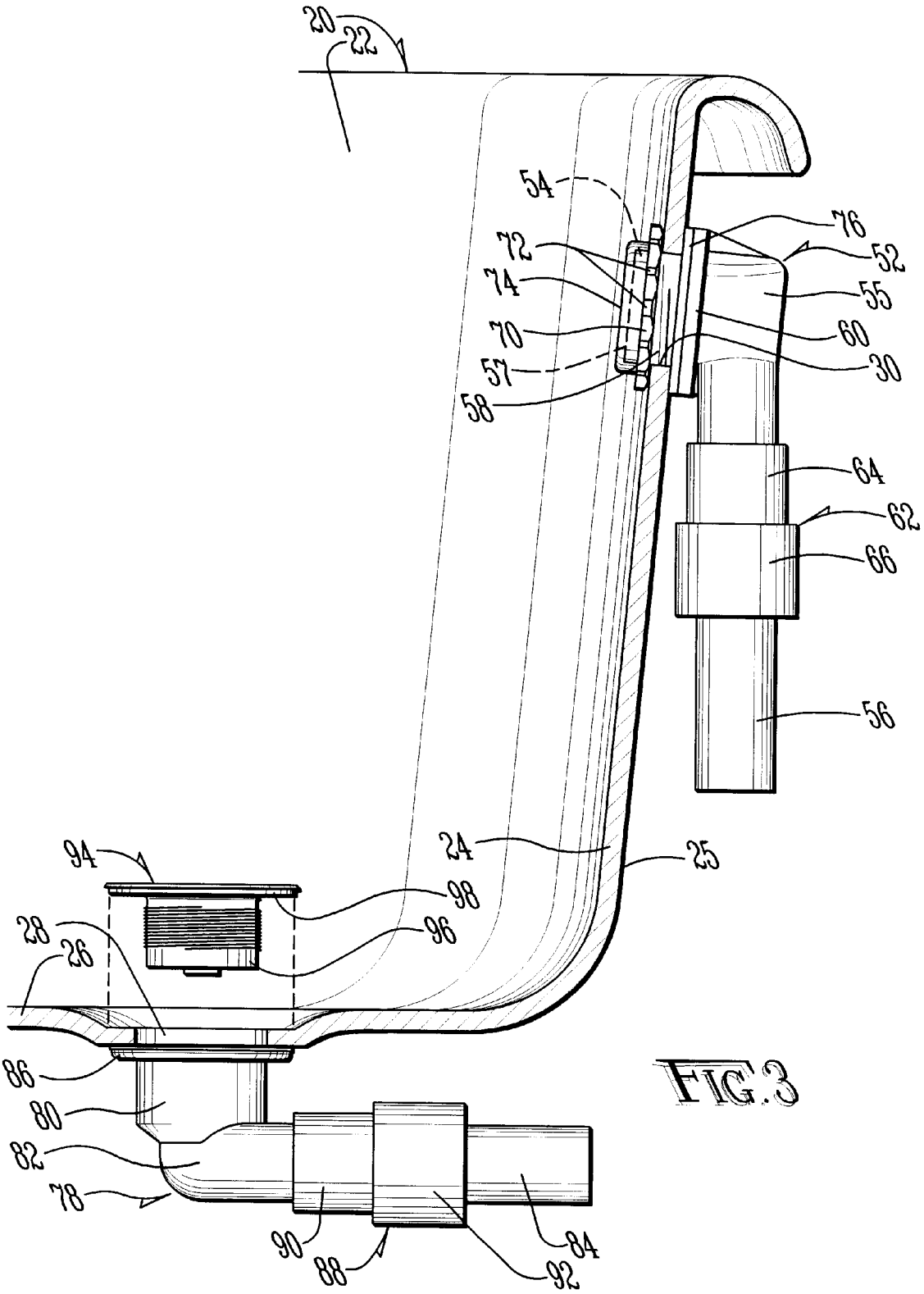
FIG. 3 is a side sectional view similar to that of FIG. 2 but in a second stage of assembly.

With reference to FIG. 3, a drain assembly 78 is secured to the drain port 28. The drain assembly 78 has a first end 80, an elbow portion 82, and a second end 84. The first end 80 has a horizontal rim 86 that surrounds the drain port 28 on the bottom 26 of the bathtub 20. Slidably connected to the second end 84 is a drain hub 88 with a first section 90 and a second section 92. The first section 90 has a diameter slightly greater than the diameter of the second end 84 and the second section 92 has a diameter greater than the diameter of the first section 90.

The drain assembly further includes a strainer 94 with a cylindrical wall 96 that is externally threaded, and an annular flange 98. The cylindrical wall 96 extends through the drain port 28 and is threadably received within the first end 80 of the drain assembly 78 and secures the drain assembly 78 to the bathtub by compressing the bottom 26 of the tub 20 between the annular flange 98 and the horizontal rim 86.

Figure 4:
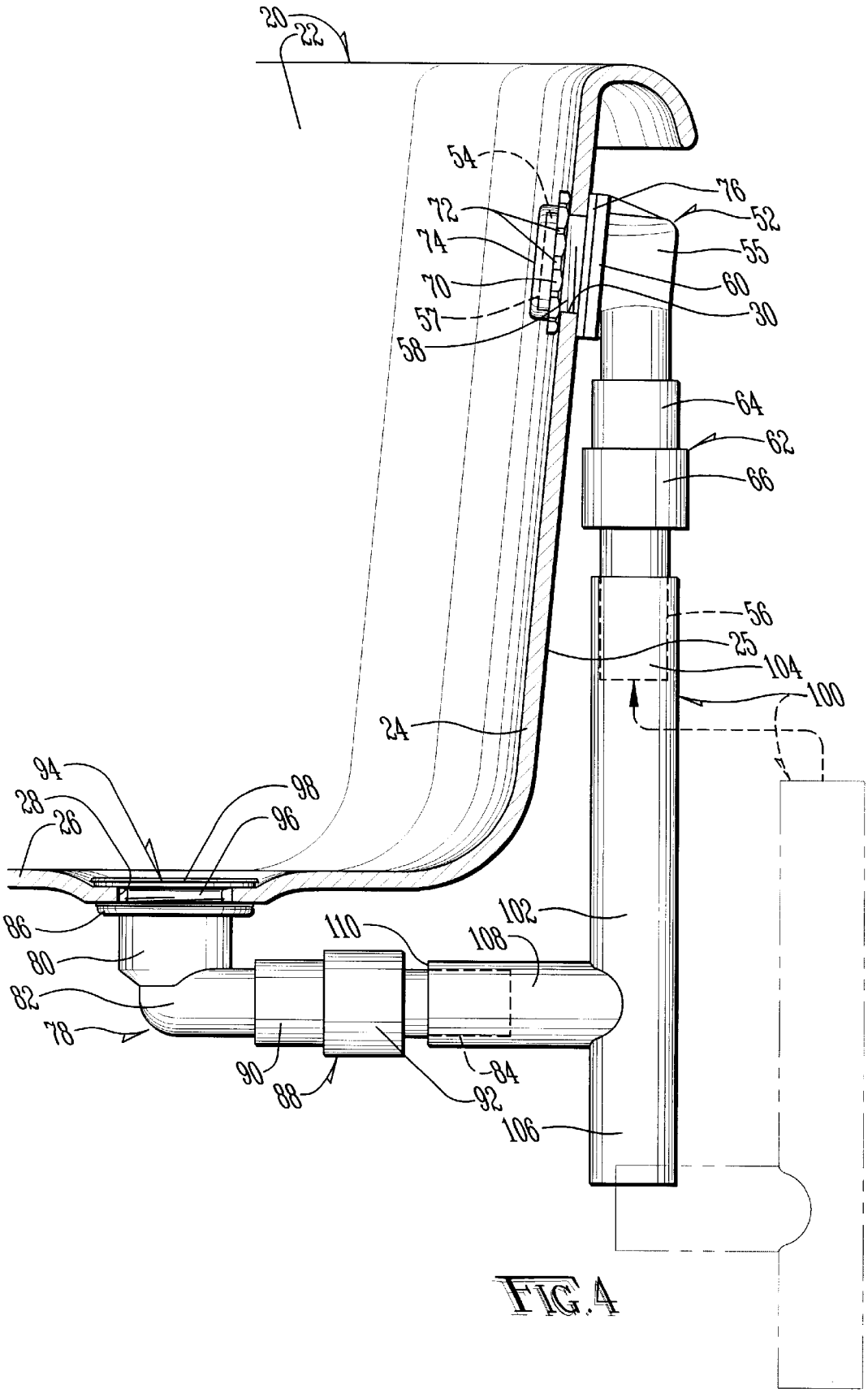
FIG. 4 is a side sectional view showing the installation of the T-section to the overflow assembly and the drain assembly.

With reference to FIG. 4, a T-section 100 is secured to the overflow assembly 52 and the drain assembly 78. The T-section has a vertical member 102 with a first end 104 and a second end 106, and a horizontal member 108 with an outward end 110. The first end 104 of the vertical member 102 has an inner diameter sufficient to receive the second end 56 of the overflow assembly 52 and an outer diameter that is capable of being received within the second section 66 of the overflow hub 62. Likewise, the outward end 110 of the horizontal member 108 has an inner diameter sufficient to receive the second end 84 of the drain assembly 78 and an outer diameter capable of being received within the second section 92 of the drain hub 88.

Figure 5:
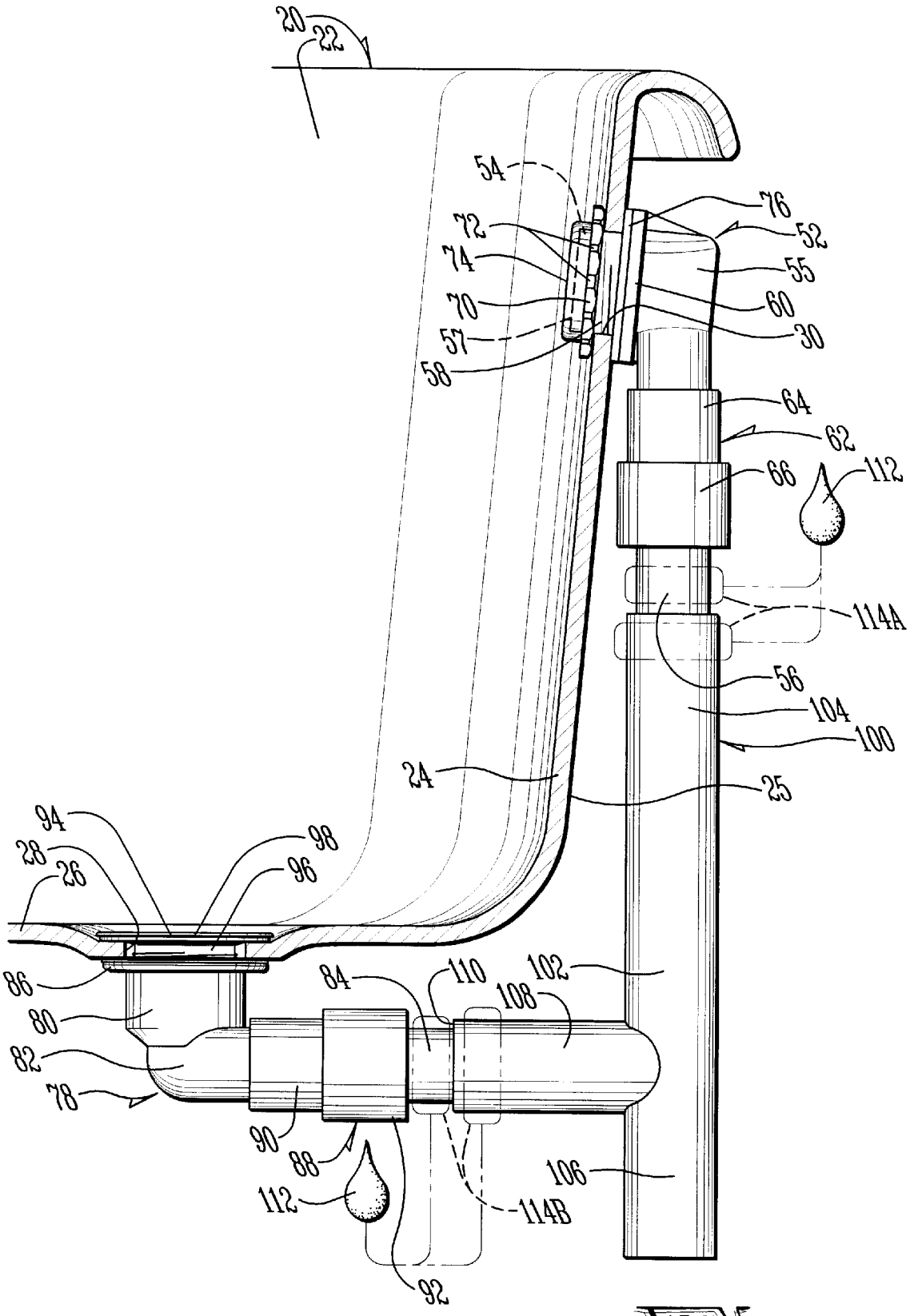
FIG. 5 is a side sectional view showing the application of the adhesive material to the bath assembly.
Figure 6:
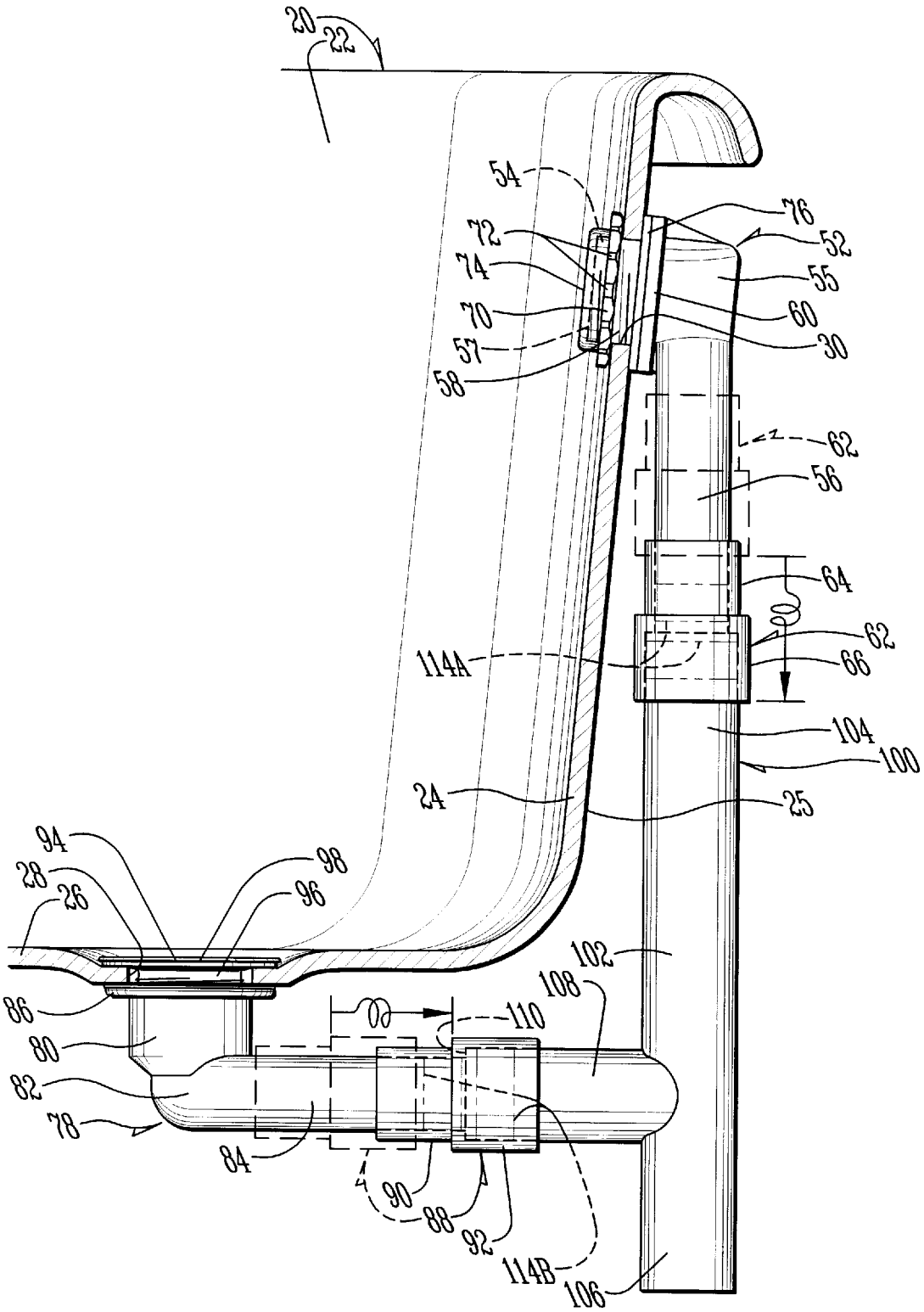
FIG. 6 is a side sectional view of the bath assembly showing the movement of the hubs.
Figure 7:
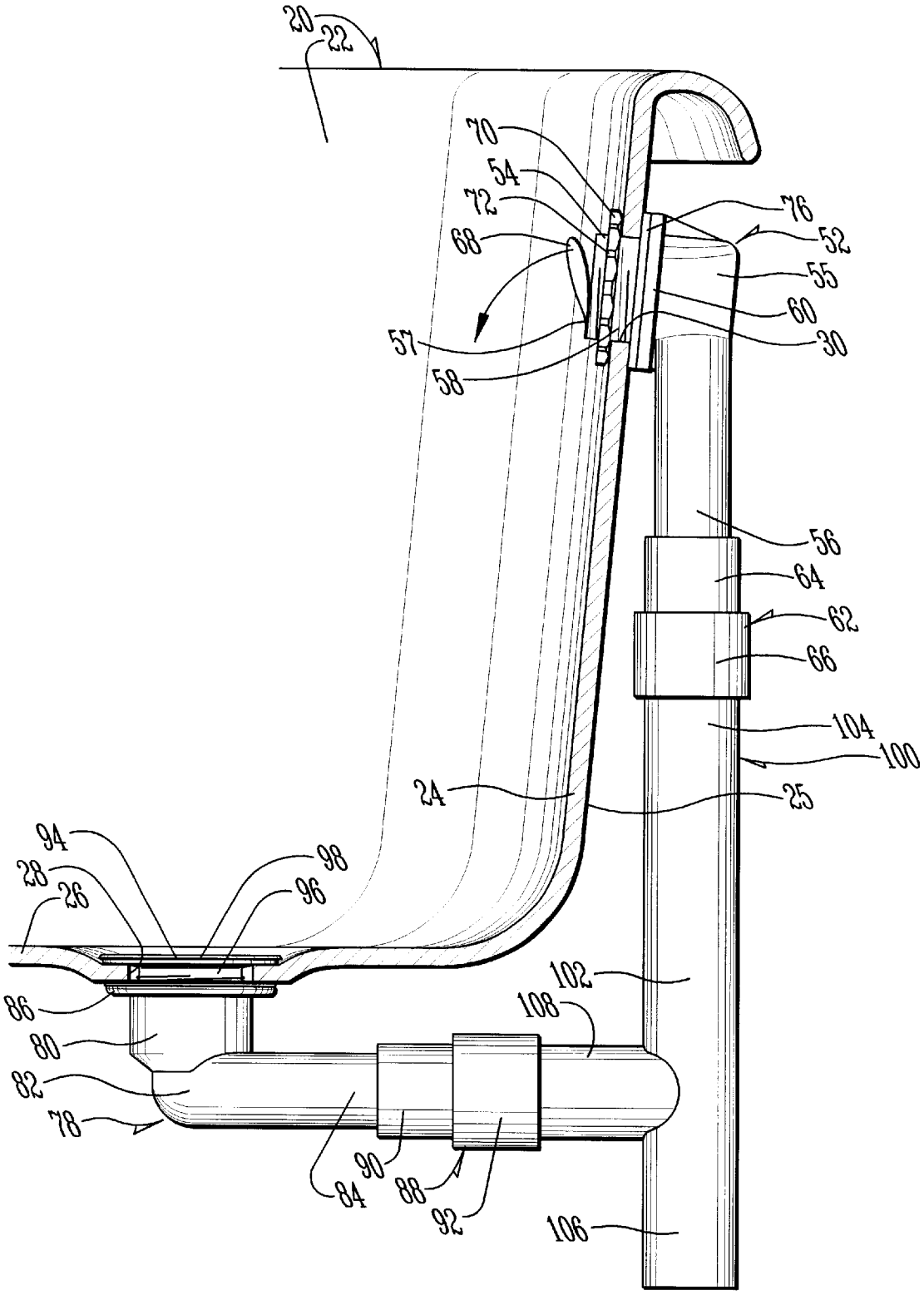
FIG. 7 is a side sectional view of the bath assembly showing the removal of the diaphragm.

During installation, as shown in FIG. 5, an adhesive material 112 is applied to selected areas 114A and 114B of the second end 56 of the overflow 52, the second end 84 of the drain assembly 78, the outward end 110 of the horizontal member 108, and the first end 104 of the vertical member 102. Solvent cement is the preferred adhesive material 112. Once the adhesive material 112 has been applied to the selected areas 114A and 114B, the overflow hub 62 is slidably mounted on the second end 56 of the overflow assembly 52 to receive the first end 104 of the horizontal member 102 and cover the selected area 114A (FIG. 6). Likewise, the drain hub 88 is slidably mounted on the second end 84 of the drain assembly 78 to receive the outward end 110 of the horizontal member 108 and cover the selected area 114B (FIG. 6). To improve the connection between the overflow assembly 52, the drain assembly 78 and the T-section 100, the overflow hub 62 and the drain hub 88 are rotated several times to spread the adhesive material 112 sufficiently around the selected area 114.

The method of installing the bath assembly begins by inserting the inlet 59 of the overflow assembly 52 through the overflow port 30 from the back side of the end wall 24 of the tub 20 and screwing on the nut element 70 so that the end wall 24 is compressed between the nut element 70 and the lip 60 of the overflow assembly. It is preferred that the washer 76 be placed on the inlet 59 prior to inserting the inlet through the overflow port and screwing on the nut element 70.

Next, the drain assembly 78 is held on the bottom 26 of the tub 20 and over the drain port 28 as the strainer 94 is inserted through the drain port 28 and is threadably received within the first end 80 of the drain assembly 78 such that the bottom 26 of the tub 20 is compressed between the annular flange 98 of the strainer 94 and the horizontal rim 86 of the drain assembly 78. If testing is to be performed, a test plug can be used in place of the strainer.

Next, the T-section 100 is slipped over the second end 56 of the overflow assembly 52 and the second end 84 of the drain assembly 78 such that end 56 fits within first end 102 and end 84 fits within outward end 110. Once fitted, adhesive material 112 is applied to selected areas 114A and 114B and the overflow hub 62 and the drain hub 88 are slidably mounted over the respective selected areas. It is preferred that after hubs 62 and 88 have been located over the respective areas 114A and 114B, the hubs be rotated about the selected areas several time to insure that the adhesive material 112 is sufficiently spread around the selected area.

In a testing procedure, having determined that there are no leaks, and after purging the water from the system, the diaphragm 68 is removed from the overflow assembly 52 by cutting the diaphragm or using any other conventional method.

Finally, the cap or face plate 74 is mounted on the nut element 70 and a valve closer or stopper (not shown) is installed by conventional means within the strainer 94.

It is therefore send that this invention has been set forth in the drawings and specification and although specific terms are employed, these are used in a generic or descriptive sense only and are not used for purposed of limitation. Changes in the form and proportion of parts as well as in the substitution of equivalents are contemplated as circumstances suggest or render expedient without departing from the spirit and scope of the invention as further defined in the following claims.

What is claimed is:

1. A bathtub assembly for a bathtub which has a bottom and adjacent side and end walls, an overflow port in an end wall, and a drain port in the bottom, comprising an overflow assembly having a first end and a second end with an overflow hub slidably connected to the second end of the overflow assembly; the overflow assembly secured to the overflow port at the first end of the overflow assembly;

a drain assembly having a first end and a second end with a drain hub slidably connected to the second end of the drain assembly; the drain assembly secured to the drain port at the first end of the drain assembly; and a T-section having a vertical member with a first end, and a second end and a horizontal member where the first end of the T-section receives the second end of the overflow assembly and is adhesively connected to the second end of the overflow assembly within the overflow hub, and the horizontal member of the T-section receives the second end of the drain assembly and is adhesively connected to the second end of the drain assembly within the drain hub.

2. A method of assembling a bathtub assembly for a bathtub which has a bottom and adjacent side and end walls, and overflow port in an end wall, and a drain port in the bottom, comprising the steps of:

securing an overflow assembly, with a first end and a second end having a slidable overflow hub, to the overflow port at the first end of the overflow assembly;

securing a drain assembly, with a first end and a second end having a slidable drain hub, to the drain port at the first end of the overflow assembly; and adhesively securing a T-section, having a vertical member with a first and a second end and a horizontal member, to the second end of the overflow assembly and the second end of the drain assembly, wherein the first end of the vertical member receives the second end of the overflow assembly and the horizontal member receives the second end of the drain assembly.

3. The method of claim 2 comprising the further steps of adhesively securing the T-section to the overflow assembly by applying an adhesive material to a first end of the vertical member and the second end of the overflow assembly and sliding the overflow hub over the first end of the vertical member and the second end of the overflow assembly.

4. The method of claim 3 further comprising the step of rotating the overflow hub about the second end of the overflow assembly and the first end of the vertical member.

5. The method of claim 2 comprising the further steps of adhesively securing the T-section to the drain assembly by applying an adhesive material to an end of the horizontal member and the second end of the drain assembly and sliding the drain hub over the end of the horizontal member and the second end of the drain assembly.

6. The method of claim 5 further comprising the step of rotating the drain hub about the second end of the drain assembly and the end of the horizontal member.

7. The method of claim 2 further comprising the step of removing a diaphragm from the first end of the overflow assembly.

8. A method of assembling a bathtub assembly for installation with a bathtub having a bottom drain port and an overflow port in an end wall of the tub above the bottom drain port, comprising, taking a vertically disposed overflow pipe with an overflow port drain fitting in an upper end;

securing the overflow port drain fitting onto the overflow drain port in the tub;

taking a horizontally disposed drain pipe with a bottom drain port fitting on one end;

securing the bottom drain port fitting to the bottom drain port of the tub;

slidably placing hubs on the vertically disposed overflow pipe and the horizontally disposed drain pipe with the hubs having a first and second diameter portions, with the first diameter portions being complimentary in size to outer diameters of the overflow pipe and the drain pipe, and with the second diameter portions being slightly larger than the first diameter portions;

taking a T-shaped pipe having an upper leg and a horizontal leg with a diameter to slidably receive a lower end of the overflow pipe, and the inner end of the drain pipe;

slidably placing the upper end of the upper leg over a lower end of the overflow pipe;

slidably placing an inner end of the horizontal drain pipe within the outer end of the horizontal leg;

placing adhesive on the junctures of the legs of the T-shaped pipe and the overflow pipe and the horizontal drain pipe; and sliding the hubs over junctures to rigidly secure the legs of the T-shaped pipe to the respective overflow pipe and the horizontal drain pipe.

* * * * *